US007870692B2

(12) United States Patent
Gregg

(10) Patent No.: US 7,870,692 B2
(45) Date of Patent: Jan. 18, 2011

(54) GUTTER COVER

(75) Inventor: David Gregg, Welches, OR (US)

(73) Assignee: Premier Futter Cover LLC, Clackamas, OR (US)

( * ) Notice: Subject to any disclaimer, the term of this patent is extended or adjusted under 35 U.S.C. 154(b) by 0 days.

(21) Appl. No.: 11/380,821

(22) Filed: Apr. 28, 2006

(65) Prior Publication Data

US 2006/0283097 A1 Dec. 21, 2006

Related U.S. Application Data

(63) Continuation-in-part of application No. 29/232,460, filed on Jun. 20, 2005, now Pat. No. Des. 558,309.

(51) Int. Cl.
*E04D 13/00* (2006.01)

(52) U.S. Cl. ..... 52/12; 428/135

(58) Field of Classification Search ..... 52/11, 52/12, 16, 670; 248/48.1, 48.2; 210/163, 210/164, 473, 474; 428/135; 29/6.1
See application file for complete search history.

(56) References Cited

U.S. PATENT DOCUMENTS

| | | | | | |
|---|---|---|---|---|---|
| 183,519 | A | | 10/1876 | Vaile | |
| 189,431 | A | | 4/1877 | Creighton | |
| 274,393 | A | | 3/1883 | Schaffert | |
| 453,948 | A | | 6/1891 | Smith et al. | |
| 474,422 | A | | 5/1892 | Stephens | |
| 642,056 | A | * | 1/1900 | Turnbull | 52/670 |
| 738,825 | A | * | 9/1903 | Mallory | 52/670 |
| 875,154 | A | * | 12/1907 | Clark | 29/6.2 |
| 1,343,461 | A | * | 6/1920 | Marberg | 52/11 |
| 1,349,264 | A | | 8/1920 | Busse | |
| 2,209,741 | A | * | 7/1940 | Sullivan et al. | 210/474 |
| 2,271,081 | A | | 1/1942 | Layton | |
| 2,558,185 | A | * | 6/1951 | Leisen | 55/520 |
| 3,351,206 | A | | 11/1967 | Wennerstrom | |
| 3,388,555 | A | | 6/1968 | Foster | |
| 3,977,135 | A | * | 8/1976 | Hunley, Jr. | 52/12 |
| 4,273,836 | A | * | 6/1981 | Campbell et al. | 428/595 |
| 4,307,976 | A | | 12/1981 | Butler | |
| 4,404,775 | A | | 9/1983 | Demartini | |
| 4,411,110 | A | | 10/1983 | Carey | |
| 4,435,925 | A | | 3/1984 | Jefferys | |
| 4,757,649 | A | | 7/1988 | Vahldieck | |
| 4,907,381 | A | | 3/1990 | Ealer | |
| 4,941,299 | A | * | 7/1990 | Sweers | 52/12 |
| 4,959,932 | A | * | 10/1990 | Pfeifer | 52/12 |
| 4,965,969 | A | | 10/1990 | Antenen | |
| 5,072,551 | A | | 12/1991 | Manoogian, Jr. | |
| 5,181,350 | A | | 1/1993 | Meckstroth | |
| 5,375,379 | A | | 12/1994 | Meckstroth | |
| 5,438,803 | A | * | 8/1995 | Blizard, Jr. | 52/12 |
| 5,459,965 | A | | 10/1995 | Meckstroth | |
| 5,619,825 | A | | 4/1997 | Leroney et al. | |
| 5,788,848 | A | * | 8/1998 | Blanche et al. | 210/162 |

(Continued)

*Primary Examiner*—Brian E Glessner
*Assistant Examiner*—Adriana Figueroa
(74) *Attorney, Agent, or Firm*—McKee, Voorhees & Sease, P.L.C.

(57) ABSTRACT

A gutter cover distributing water across the face of the cover and controlling the rate of water ingress through the cover into the gutter thereby assisting in the separation of water and shedding of debris from the passing runoff water and debris, and preventing debris from building up on the gutter cover.

26 Claims, 5 Drawing Sheets

U.S. PATENT DOCUMENTS 5,848,857 A * 12/1998 Killworth et al. ..... 405/118
5,893,240 A 4/1999 Ealer, Sr.
5,956,904 A 9/1999 Gentry
D415,296 S 10/1999 Gavin
6,151,837 A 11/2000 Ealer, Sr.
6,511,595 B2 * 1/2003 Crompton et al. ..... 210/162
6,536,165 B2 3/2003 Pilcher
6,688,045 B1 2/2004 Pilcher
6,699,563 B1 * 3/2004 Alhamad ..... 428/136
6,951,077 B1 10/2005 Higginbotham
2001/0022052 A1 9/2001 Pilcher
2002/0124476 A1 * 9/2002 Iannelli ..... 52/11
2003/0046876 A1 * 3/2003 Higginbotham ..... 52/11
2005/0166465 A1 * 8/2005 Banks et al. ..... 52/11
2006/0163129 A1 * 7/2006 Swistun ..... 210/162
2006/0179723 A1 * 8/2006 Robins ..... 52/11

* cited by examiner

GUTTER COVER

CROSS-REFERENCE TO RELATED APPLICATIONS

This application is a continuation-in-part of U.S. patent application Ser. No. 29/232,460 filed on Aug. 4, 2005, which is a nonprovisional U.S. design application, herein incorporated by reference in its entirety.

FIELD OF THE INVENTION

The present invention relates generally to a gutter cover. The gutter cover distributes water across the face of the cover and controls the rate of water ingress through the cover into the gutter thereby assisting in the separation of water and shedding of debris from the passing runoff water and debris, and preventing debris from building up on the gutter cover.

BACKGROUND OF THE INVENTION

Numerous attempts have been made to construct a gutter cover capable of dealing with various and sundry types of debris, weather conditions and volume flows of runoff water from a roof. The first embodiments of the gutter cover were constructed under the school of thought that increasing the gap size of the expanded metal increased the ability of the cover to ingress water while yet shedding debris. These embodiments often captured and stalled debris of all sizes on top of the mesh because of the high rate of water ingress through the screen. They also permitted debris, such as pine needles, smaller leaves and sediments, to clog the screen or the gutter. Recognizing these problems, others began to shape the screen in a convex manner over the gutter to encourage debris shedding. However many of these embodiments because of the convexity of the screen also presented crevices and nooks where debris could collect and ultimately clog the screen. Others recognized that the screen was still able to ingress high volumes of water by using the expanded metal as a skeleton to layer over top a fine mesh material for shedding smaller debris. These proved effective for the first few months after installation but eventually clogged due to the fineness of the mesh. Still, others recognized that a solid plate in combination with expanded metal could be used to handle high volumes of runoff, yet provide a smaller surface area to attract collecting debris. These often used a piece of sheet metal in combination with a medium mesh size expanded metal; however, after time the expanded metal still collected debris and exhibited an impaired shedding ability. These gutter covers, like those previously listed, failed to recognize that for the cover to effectively shed debris the cover and expanded metal member had to be designed to distribute the ingressing water across the face of the expanded metal and control the rate at which the runoff water ingresses through the expanded metal. Previous attempts also failed to realize the importance of the angle of the louvered surfaces within various expanded metals and the direction of the louver with respect to the direction of the flow of the runoff water. The angle of the louvered surface is critical to controlling the distribution of runoff across the face of the expanded metal and subsequently controlling the rate of water ingress through the expanded metal, as well as whether the expanded metal traps and collects debris. The angle of the louvered surface plays a key role in whether debris will shed easily across the face of the expanded metal or have a tendency to get hung up by the louvered surfaces or drawn down into the expanded metal.

Therefore, a primary objective of the present invention is to provide a gutter cover that accounts for and remedies the failings of previous gutter covers.

Therefore, a further objective of the present invention is to provide a gutter cover that distributes water across the face of the cover an controls the rate of water ingress through the cover into the gutter thereby assisting in the separation of water and shedding of debris from the passing runoff water and debris.

A still further objective of the present invent on is to provide a gutter cover having an expanded metal member with louvered surfaces wherein the angle of the louvered surface is at least 90 degrees with respect to the top surface of the expanded metal member.

Another objective of the present invention is to provide a breaker plate that is secured to the expanded metal member to prevent water traveling on the bottom surface of the expanded metal member from traveling over the top of the gutter.

A further objective of the present invention is to provide a gutter cover having a v-shaped trough between and running parallel to the breaking plate for breaking up and slowing the water before reaching the gutter cover.

A still further object of the present invention is to provide a gutter cover with an expanded metal member having a longitudinal width between the overlapping sides being greater than a latitudinal width between the overlapping sides.

These and/or other objectives will become apparent from the following specification and claims.

SUMMARY OF THE INVENTION

In its broadest sense, the invention comprises a gutter cover. The gutter cover distributing water across the face of the cover and controlling the rate of water ingress through the cover into the gutter thereby assisting in the separation of water and shedding of debris from the passing runoff water and debris, and preventing debris from building up on the gutter cover. The gutter cover includes a solid sheet member having a top surface, an opposite bottom surface, a first edge for positioning under a roofing material and a second parallel edge. The gutter cover also includes an expanded metal member having a top surface, an opposite bottom surface, a first and second parallel edges, where the first edge is secured to the second edge of the solid sheet member. A breaker plate is secured to the second edge of the expanded metal member to thereby assist in preventing water on the bottom surface of the expanded metal member from traveling beyond the second edge over the gutter. The expanded metal member further includes a plurality of honeycomb shapes each having parallel sides. The honeycombs shapes are connected by overlapping a pair of the sides. The longitudinal width between the overlapping sides is greater than the latitudinal width between the overlapping sides. A plurality of louvered surfaces are formed by the pair of overlapping sides. And, the louvered surfaces have an angle greater than 90 degrees with respect to the top surface of the expanded metal member. The angle of the louvered surfaces helps distribute water across the face of the expanded metal member and controls the rate of water ingress through the plurality of honeycombs into the gutter. The angles of the louvered surface also assists in the separation of water and shedding of the debris from the passing runoff water and debris, and prevents debris from building up on the gutter cover.

According to another feature of the present invention, the solid sheet member has a v-shaped trough between and running parallel to the first and the second parallel edges for breaking up and slowing the water before reaching the gutter cover.

According to another feature of the present invention, the second edge of the solid sheet member further comprises a first and a second fold parallel to the second edge. The first fold creating a first flap by folding the second edge over the top surface of the sheet member. The second fold creating a second flap by folding the second edge and first flap under the bottom surface of the sheet member. The expanded metal member being crimped between the first and second flaps to secure the expanded metal member to the sheet member.

According to another feature of the present invention, the breaker plate further comprises parallel edges, a top and an opposite bottom surface, a first fold creating a first flap for crimping the expanded metal member to the breaker plate between the first flap and the bottom surface of the metal member. The breaker plate also includes a second parallel fold creating a second flap for preventing water on the bottom surface of the expanded metal member from traveling over the gutter.

According to another feature of the present invention, the second flap has an angle greater than 90 degrees with respect to the bottom surface of the expanded metal member.

According to another feature of the present invention, the gutter cover is used with K-style gutter, ogee gutter, half round gutter, fascia gutter and box gutter.

According to another feature of the present invention, the first edge of the solid sheet member slides up under the roofing material to thereby assist in the transition of runoff water and debris from the roof onto the gutter cover.

According to another feature of the present invention, the gutter cover is secured to the gutter by inserting a zip screw through the breaker plate into the gutter.

DETAILED DESCRIPTION OF A PREFERRED EMBODIMENT

Figure 1:
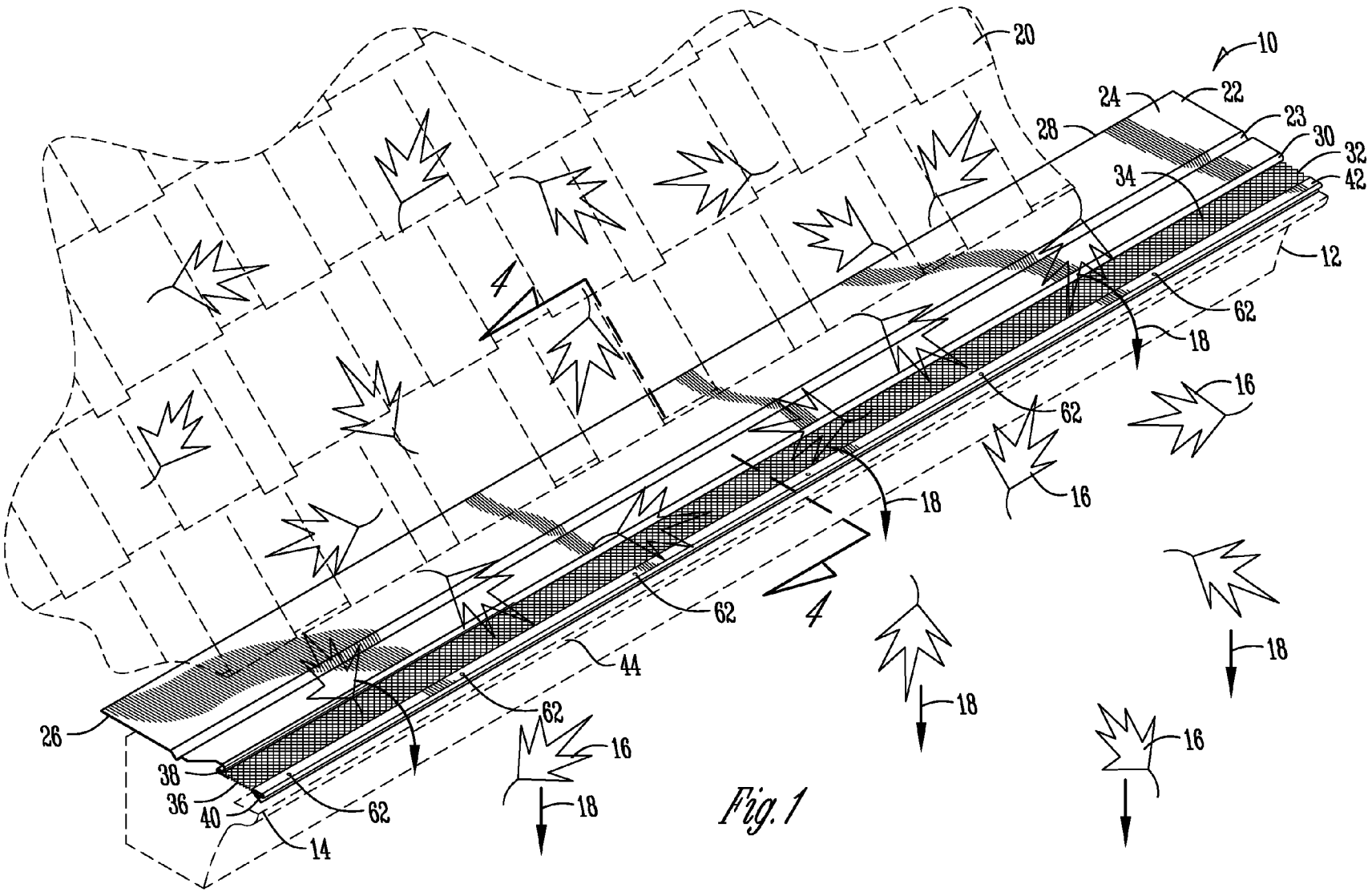
FIG. 1 is a perspective view of the gutter cover.

Turning now to the drawings in which similar reference characters denote similar elements through the several views. Illustrated in FIGS. 1-6 is the combination of various views and in-use configurations of the gutter cover. The gutter cover being described with particularity herein.

The gutter cover is referred to generally as 10. In FIG. 1, the gutter cover 10 is shown positioned over the gutter 12. The gutter cover 10 is secured to the gutter 12 using zip screws 62. The zip screws 62 fasten through the breaker plate 42 into the front edge 14 of the gutter 12. The gutter plate 10 has a solid sheet member 22. The solid sheet member 22 has a top surface 24 and opposite bottom surface 26. The solid sheet member 22 also includes a first edge 28 and a second parallel edge 30. The first edge 28 of the solid sheet member 22 is positioned beneath the roofing material 20. Thus, the gutter cover 10 is secured firmly having the first edge 28 of the solid sheet member 22 positioned under the roofing material and the breaker plate 42 being screwed using zip screw 62 to the front ledge 14 of the gutter 12.

Debris 16 travels down the roofing material 20 toward the gutter cover 10 transitioning across the roofing material overlap on top of the top surface 24 of the solid sheet member 22 following the debris path arrows 18. The solid sheet member 22 also has a V-shaped groove 23 for slowing and breaking up the run-off water from the roofing material 20, along with the debris 16. Thus, rain 17 travels down the roofing material 20 across the top surface 24 of the solid sheet member 22 and into the V-shaped groove 23 to be broken up, slowed, and evenly distributed across the top surface 34 of the gutter cover 10.

Figure 2:
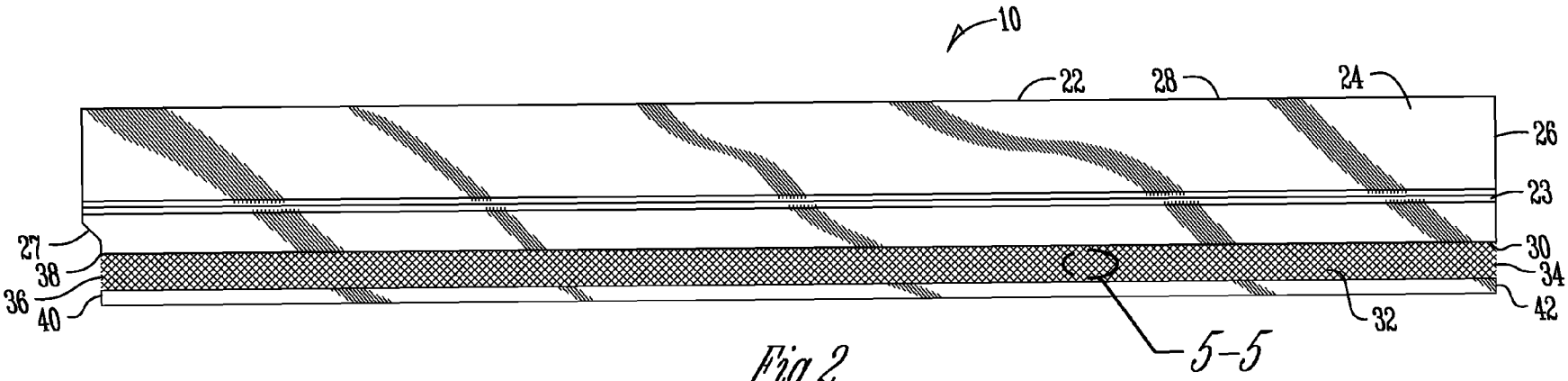
FIG. 2 is a top plan view thereof.

FIG. 2 is top plan view of the gutter cover. In FIG. 2, the gutter cover 10 is shown with solid sheet member 22 having the V-shaped groove 23. The solid sheet member 22 has a first edge 28 and a second parallel edge 30. The expanded metal member 32 has a top surface 34 and opposite bottom surface 36. The expanded metal member 32 also has a first edge 38 and a second parallel edge 40. The first edge 38 of the expanded metal member 32 is connected to the second edge 30 of the solid sheet member 22. FIG. 2 also shows the top surface 48 of the breaker plate 42. The breaker plate 42 is connected to the second edge 40 of the expanded metal member 32. The gutter cover 10 also includes angle area 27 to facilitate overlapping of the gutter cover 10 sections.

Figure 3:
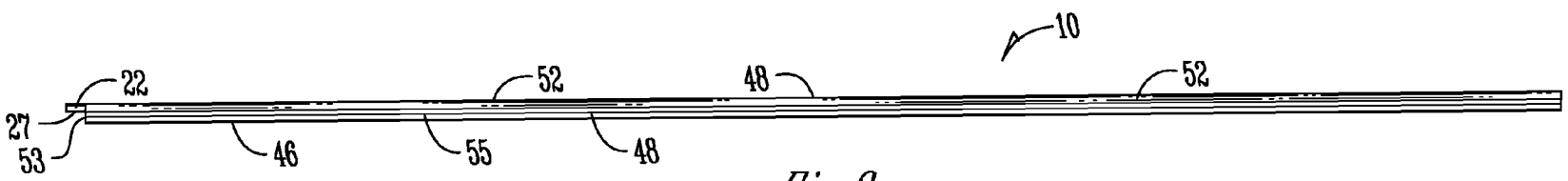
FIG. 3 is a front elevational view thereof.

FIG. 3 is a front elevation view of the gutter cover. FIG. 3 also shows the sectional overlap area 27 on the gutter cover 10. The sectional overlap area 27 being for convenience in installing the gutter cover 10. In FIG. 3, the breaker plate 42 is best illustrated. Particularly, the breaker plate 42 has parallel edges 46 separated by a top surface 48 and a bottom surface 50.

Figure 4:
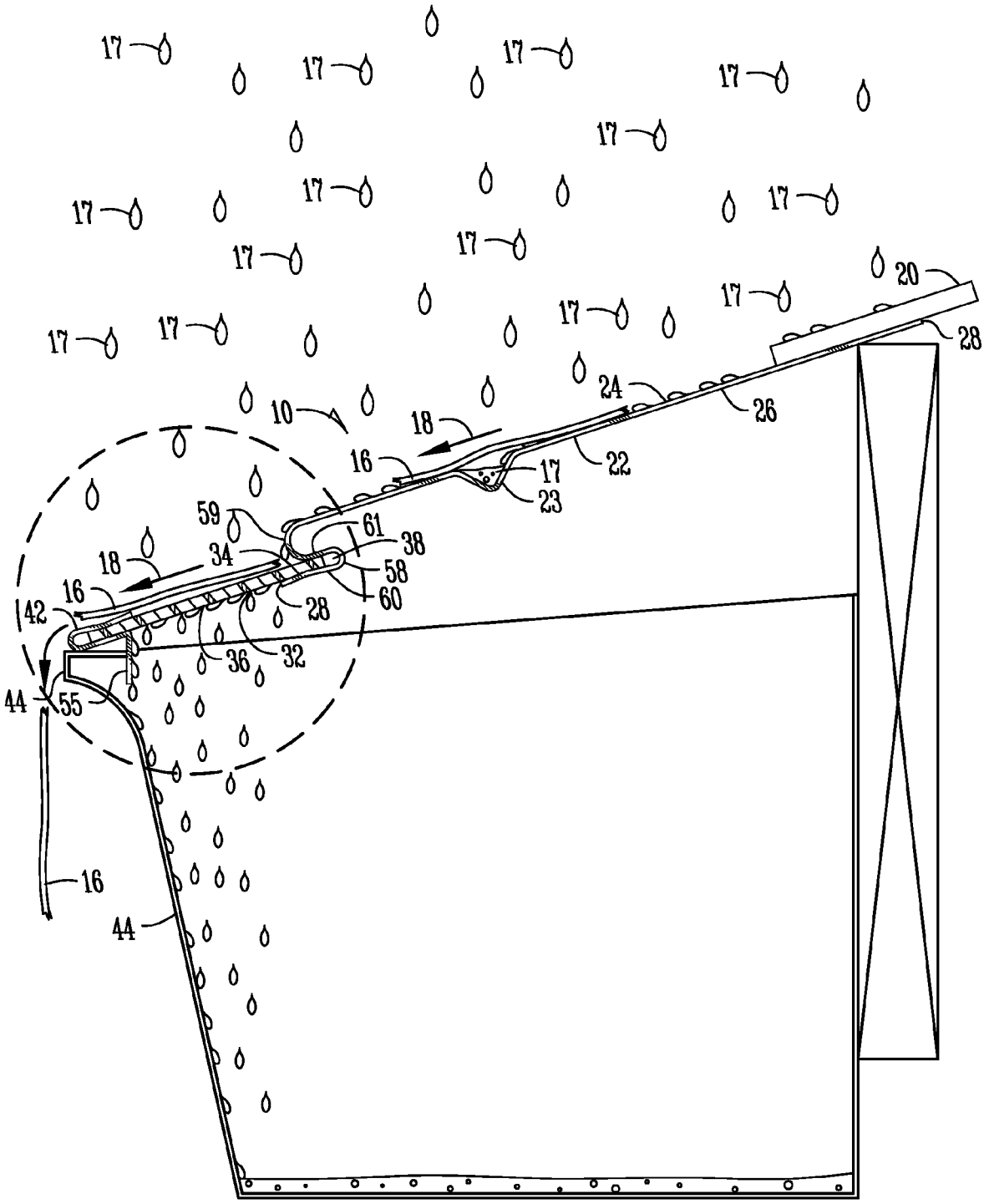
FIG. 4 is a sectional view taken along line 4-4 in FIG. 1.

FIG. 4 is a sectional view taken along line 4-4 in FIG. 1. FIG. 4 shows generally the path 18 of debris 16 and rain 17 along the gutter cover 10. The gutter cover 10 is positioned on top of the gutter 12. The gutter cover 10 consists of a solid sheet member 22 attached to an expanded metal member 32, where the expanded metal member 32 is attached to the breaker plate 42. Rain 17 and debris 16 traveling on the roofing material 20 transitions from the roofing material 20 to the gutter cover 10 near the first edge 28 of the solid metal member 22. The first edge 28 of the solid metal member 22 is overlapped by the roofing material 20. The rain 17 travels across the top surface 34 of the solid sheet member 22 and into the V-shaped groove 23 to be broken up, slowed and distributed across the face of the gutter cover 10. The rain 17 and debris 16 travels over the top surface 34 of the expanded metal member 32. The obtuse angle of the plurality of louvered surfaces 76 separates the rain 17 from debris 16 while allowing debris 16 to travel along the debris path 18 across the top surface 34 of the expanded metal member 32 without being caught up or drawn to the top surface 34 of the expanded metal member 32. Rain 17 passing through the expanded metal member 32 and traveling along the bottom surface 36 is shed from the bottom surface 36 of the expanded metal member 32 using breaker plate 42. The breaker plate 42 secures the second edge 40 of the expanded metal member 32 to the front ledge of the gutter 12 using zip screws 62.

On the top surface 34 of the expanded metal member 32, the debris 16 passes along the debris path 18 across the top surface 34 of the expanded metal member 32 and across the top surface 48 of the breaker plate 42 and further traveling across the top surface of the first fold 52 and over the front ledge 14 of the gutter 12. The expanded metal member 32 in combination with the plurality of louvered surfaces 76 distributes rain 17 across the top surface 34 of the expanded metal member 32 thereby controlling the rate of which the rain 17 ingresses through the expanded metal member 32 and into the gutter 12 to assist in separation of the rain 17 and shedding of the debris 16 from the passing run off rain 17 and debris 16. The expanded metal member 32 in combination with the plurality of louvered surfaces 76 also prevents and discourages debris 16 from building up on the top surface 34 of the expanded metal member 32.

Figure 5:
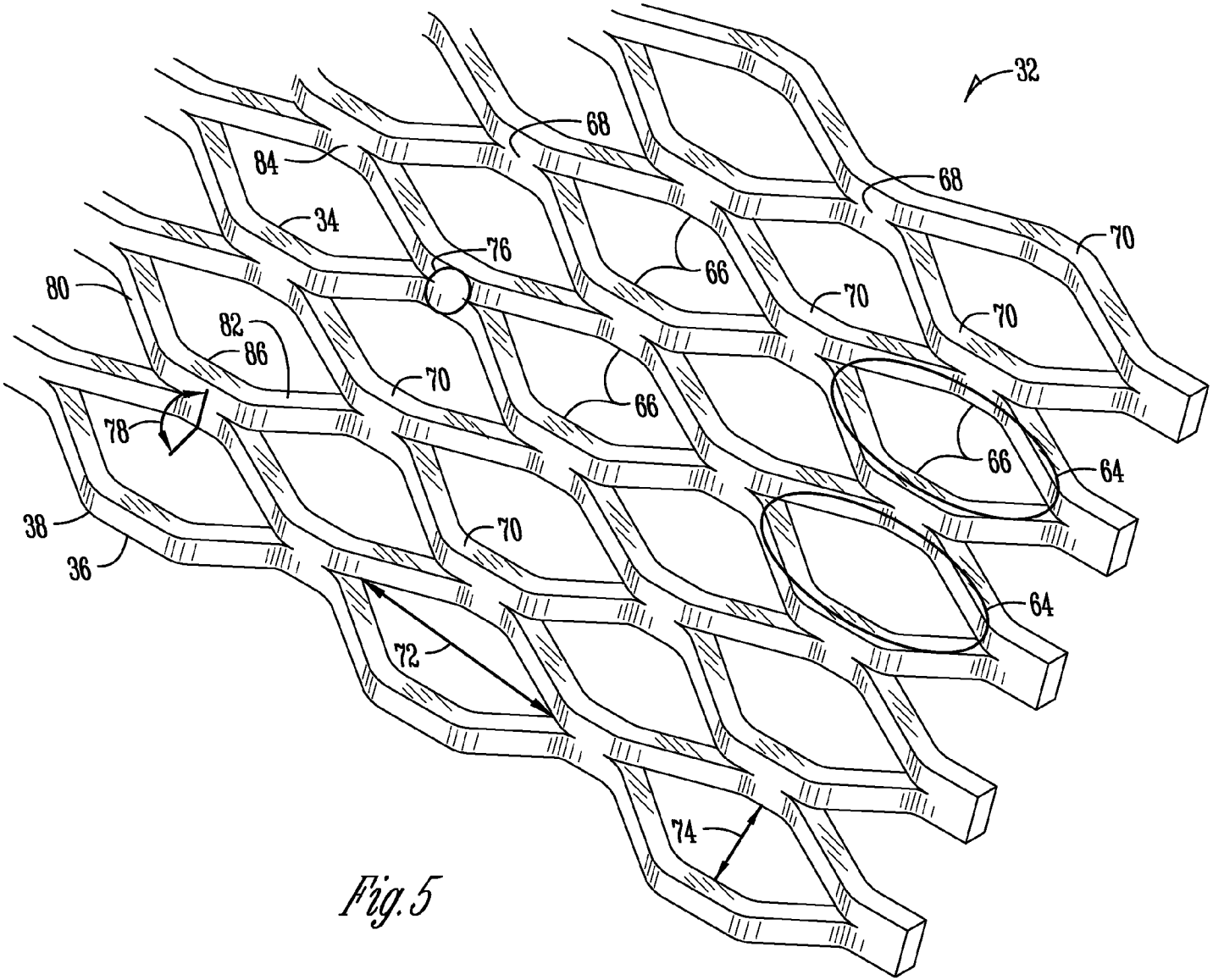
FIG. 5 is a perspective view taken along line 5-5 in FIG. 2.

FIG. 5 is an angled isometric view taken along line 5-5 in FIG. 2. In FIG. 5, the expanded metal member 32 is shown with greater detail. In particular, the expanded metal member 32 is made up of a plurality of honeycomb shapes 64. Each of the honeycomb shapes 64 have a plurality of sides 70. A first side 80 and a second side 82 of the plurality of sides 70 are parallel to each other. The plurality of side 70 also have a top surface 86 and a bottom surface 84. Each of the honeycomb shapes 64 are connected by overlapping the bottom surface 84 of the first side 80 of one honeycomb shape 64 with the top surface 86 of the second side 82 of another honeycomb shape 64. The honeycomb shape 64 has a longitudinal width 72 between the overlapping side 68 that is preferably greater than the latitudinal width 74 between the opposite 66 overlapping sides 68. By overlapping the bottom surface 84 of the first side 80 of one honeycomb shape 64 with the top surface 86 of the second side 82 of another honeycomb shape 64 a plurality of louvered surfaces 76 are formed. The louvered surfaces 76 have preferably an angle greater than 90° with respect to the top surface 34 and first edge 38 of the expanded metal member 32. Thus, as the rain 17 travels along the top surface 34 of the expanded metal member 32 the rain 17 sees an obtuse angle as opposed to an acute angle. The obtuse angle of the louvered surfaces 76 assist in distributing rain 17 across the top surface 34 of the expanded metal member 32 and controls the rate of rain 17 ingress through the plurality of honeycombs 64 and to the gutter 12. The louver angle 78 being preferably an angle greater than 90° also assists in the separation of the rain 17 and shedding of the debris 16 along the debris path 18 from the passing runoff rain 17 and debris 16. Having a louver angle 78 greater than 90° also prevents debris 16 from building and stalling on the top surface of the expanded metal member 32. Thus, if the expanded metal member 32 can effectively shed debris 16 from off the top surface 34 of the expanded metal member 32, the gutter cover 10 is able to retain its debris 16 shedding ability over the long-term. Conversely, if rain 17 and debris 16 traveling along the top surface 34 of the expanded metal member 32 were to see a plurality of louvered surfaces 76 having a louver angle 78 less then 90°, this would cause debris 16 to be caught up and stalled along the debris path 18 on the top surface 34 of the expanded metal member 32. Also, an acute louver angle 78 with respect to the top surface 34 of the expanded metal member 32 would also promote debris along with the rain 17 to be drawn into and potentially clogging the honeycomb shapes 64. This occurs because an acute louver angle 78 aggressively ingresses rain 17 through the plurality of honeycomb shapes 64 and creates a tendency for debris 16 to be drawn into the honeycomb shapes 64 thereby stalling the debris 16 along the debris path 18 and promoting build up of debris 16 on the top surface 34 of the expanded metal member 32. Having an obtuse louver angle 78 promotes a controlled ingress of rain 17 across the top surface 34 of the expanded metal member 32 such that debris 16 is allowed to separate cleanly and transition smoothly across the top surface 34 of the expanded metal member 32.

Figure 6:
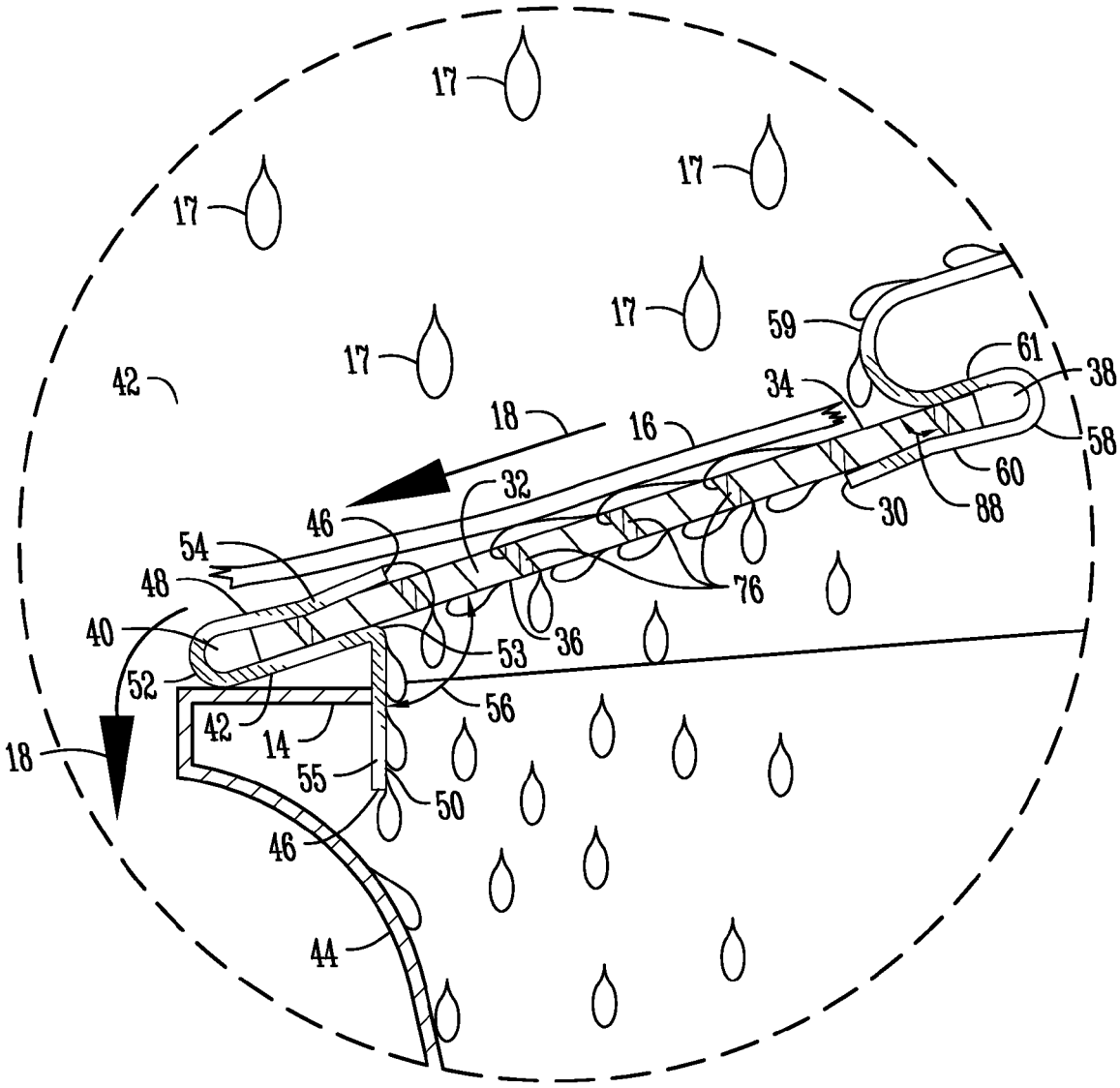
FIG. 6 is a sectional view taken along line 6-6 in FIG. 4.

FIG. 6 is a sectional view taken along 6-6 in FIG. 4. FIG. 6 illustrates debris 16 and rain 17 traveling across the top of the gutter cover 10. FIG. 6 also better illustrates how the expanded metal member 32 is connected to the solid sheet member 22 and the breaker plate 42. The solid sheet member 22 has a V-shaped groove 23, a top surface 24, an opposite bottom surface 26, a first edge and a second edge. The first edge 28 is shown overlapped by the roofing material 20 such that rain 17 and debris 16 is capable of smoothly transitioning over the top of the roofing material 20 and onto the top surface 34 of the solid sheet member 22. The rain 17 travels across the top surface 34 of the solid sheet member 22 and into the V-shaped groove 23 to be broken up, slowed and distributed across the face of the gutter cover 10. The expanded metal member 32 is attached to the solid sheet member 22 at its first edge 38. To secure the expanded metal member 32 to the solid sheet member 22, the solid sheet member 22 a first fold 58 at its second edge 30 and a second fold 59 parallel to the second edge 30. The first fold 58 creates a first flap 60 by folding the second edge 30 over the top surface 24 of the sheet metal member 22. The second fold 59 creates a second flap 61 by folding the second edge 30 and the first flap 60 underneath the bottom surface 36. The first edge 38 of the expanded metal member 32 is crimped between the first 60 and second 61 flaps to secure the expanded metal member 32 to the solid sheet member 22. Thus, rain 17 and debris 16 following the path arrows 18 follow along the top surface 24 of the solid sheet member 22 traveling over the second fold 59 and the solid sheet member 22 and onto the top surface 34 of the expanded metal member 32. The rain 17 and debris 16 travels over the top surface 34 of the expanded metal member 32. The obtuse angle of the plurality of louvered surfaces 76 separates the rain 17 from debris 16 while allowing debris 16 to travel along the debris path 18 across the top surface 34 of the expanded metal member 32 without being caught up or drawn to the top surface 34 of the expanded metal member 32. Rain 17 passing through the expanded metal member 32 and traveling along the bottom surface 36 is shed from the bottom surface 36 of the expanded metal member 32 using breaker plate 42. The breaker plate 42 secures the second edge 40 of the expanded metal member 32 to the front ledge of the gutter 12 using zip screws 62. The breaker plate is constructed of parallel edges 46 and has a top surface 48 and an opposite bottom surface 50. A first fold 52 is created for crimping the second edge 40 the expanded metal member 32 to the breaker plate 42 between the first flap 54 and the bottom surface 36 of the expanded metal member 32. A second parallel fold 53 in the breaker plate 42 creates a second flap 55 for preventing rain 17 traveling on the bottom surface 36 of the expanded metal member 32 from traveling over the front ledge 14 of the gutter 12. The second flap 55 also helps position and secure the gutter cover 10 with respect to the gutter front 44 and front ledge 14 and has angle 56 relative to the expanded metal member 32, wherein angle 56 helps position and secure the gutter cover 10 and draw rain off of the bottom of the expanded metal member 32 into the gutter 12. Thus, passing debris 16 travels along the debris path 18 across the top surface 34 of the expanded metal member 32 as well as along and across the top surface 48 of the breaker plate 42 and further traveling across the top surface of the first fold 52 and over the front ledge 14 of the gutter 12. The expanded metal member 32 in combination with the plurality of louvered surfaces 76 distributes rain 17 across the top surface 34 of the expanded metal member 32 thereby controlling the rate of which the rain 17 ingresses through the expanded metal member 32 and into the gutter 12 to assist in separation of the rain 17 and shedding of the debris 16 from the passing run off rain 17 and debris 16. The expanded metal member 32 in combination with the plurality of louvered surfaces 76 also prevents and discourages debris 16 from building up on the top surface 34 of the expanded metal member 32.

What is claimed is:

1. A gutter cover distributing water across the face of the cover and controlling the rate of water ingress through the cover into the gutter thereby assisting in the separation of water and shedding of debris from the passing runoff water and debris, and preventing debris from building up on the gutter cover, the gutter cover comprising:

a solid sheet member having a top surface, an opposite bottom surface, a first edge adapted to be positioned under roofing material and a second parallel edge;

a flat expanded metal member having a top surface, an opposite bottom surface, a first and a second parallel edges, the first edge secured to the second edge of the solid sheet member;

a breaker plate secured to the second edge of the flat expanded metal member to thereby assist in preventing water on the bottom surface of the flat expanded metal member from traveling beyond the second edge over the front of the gutter; and the flat expanded metal member further comprising:

(a) a plurality of honeycomb shapes each having a plurality of sides including a first side and second parallel side, the sides having a top and a bottom surface, the honeycombs shapes connected by overlapping the bottom surface of the first side of one honeycomb shape with the top surface of the second side of another honeycomb shape;

(b) each row of the plurality of honeycomb shapes extend in a direction perpendicular to side edges of the flat expanded metal member;

(c) a longitudinal width between the overlapping sides being greater than a latitudinal width between the overlapping sides;

(d) a plurality of louvered surfaces formed by the overlapping sides; and (e) wherein the louvered surfaces of the flat expanded metal member of the gutter cover have an angle being obtuse relative to water flow across the cover to assist in distributing water across the face of the flat expanded metal member and controlling the rate of water ingress through the plurality of honeycombs into the gutter to thereby assist in the separation of water and shedding of the debris from the passing runoff water and debris, and preventing debris from building up on the gutter cover.

2. The gutter cover of claim 1 wherein the solid sheet member having a v-shaped trough between and running parallel to the first and the second parallel edges for breaking up and slowing the water before reaching the gutter cover.

3. The gutter cover of claim 1 wherein the second edge of the solid sheet member further comprises a first and a second fold parallel to the second edge, the first fold creating a first flap by folding the second edge over the top surface of the sheet member, the second fold creating a second flap by folding the second edge and first flap under the bottom surface of the sheet member, the flat expanded metal member being crimped between the first and second flaps to secure the flat expanded metal member to the sheet member.

4. The gutter cover of claim 1 wherein the breaker plate further comprises parallel edges, a top and an opposite bottom surface, a first fold creating a first flap for crimping the flat expanded metal member to the breaker plate between the first flap and the bottom surface of the metal member, a second parallel fold creating a second flap for preventing water on the bottom surface of the flat expanded metal member from traveling over the gutter.

5. The gutter cover of claim 4 wherein the second flap has an angle greater than 90 degrees with respect to the bottom surface of the flat expanded metal member.

6. The gutter cover of claim 1 wherein the gutter cover is used with K-style gutter, ogee gutter, half round gutter, fascia gutter and box gutter.

7. The gutter cover of claim 1 wherein the first edge of the solid sheet member is adapted to slide up under roofing material to transition runoff water and debris from the roof onto the gutter cover.

8. The gutter cover of claim 1 wherein the gutter cover is secured to the gutter by inserting a zip screw through the breaker plate into the gutter for securing the gutter cover to the gutter.

9. A method of distributing water across the face of the gutter cover and controlling the rate of water ingress through the cover into the gutter thereby assisting in the separation of water and shedding of debris from the passing runoff water and debris, and preventing debris from building up on the gutter cover, the method comprising:

providing:

(a) a solid sheet member having a top surface, an opposite bottom surface, a first edge adapted to be positioned under roofing material and a second parallel edge;

(b) a flat expanded metal member having a top surface, an opposite bottom surface, a first and a second parallel edges, the first edge secured to the second edge of the solid sheet member, the flat expanded metal member;

(c) further comprising:

(i) a plurality of honeycomb shapes each having a plurality of sides including a first side and second parallel side, the sides having a top and a bottom surface, the honeycombs shapes connected by overlapping the bottom surface of the first side of one honeycomb shape with the top surface of the second side of another honeycomb shape;

(ii) each row of the plurality of honeycomb shapes extend in a direction perpendicular to side edges of the flat expanded metal member;

(iii) a longitudinal width between the overlapping sides being greater than a latitudinal width between the overlapping sides;

(iv) a plurality of louvered surfaces formed by the overlapping sides; and (v) the louvered surfaces of the flat expanded metal member of the gutter cover having an angle being obtuse relative to water flow across the cover;

(c) a breaker plate secured to the second edge of the flat expanded metal member to thereby assist in preventing water on the bottom surface of the flat expanded metal member from traveling beyond the second edge over the gutter;

(d) controlling distribution of water across the face of the expanded metal member and the rate of water ingress through the plurality of honeycombs into the gutter by passing water over the obtusely angled louvered surfaces to thereby slow the flow of water through the flat expanded metal member; and (f) carrying the debris over top the flat expanded metal member and over the front edge of the gutter by the passing runoff water and debris overtop the obtusely angled louvered surfaces for preventing debris from building up on the gutter cover.

10. The method of claim 9 wherein the solid sheet member having a v-shaped trough between and running parallel to the first and the second parallel edges for breaking up and slowing the water before reaching the gutter cover.

11. The method of claim 9 wherein the second edge of the solid sheet member further comprises a first and a second fold parallel to the second edge, the first fold creating a first flap by folding the second edge over the top surface of the sheet member, the second fold creating a second flap by folding the second edge and first flap under the bottom surface of the sheet member, the flat expanded metal member being crimped between the first and second flaps to secure the flat expanded metal member to the sheet member.

12. The method of claim 9 wherein the breaker plate further comprises parallel edges, a top and an opposite bottom surface, a first fold creating a first flap for crimping the flat expanded metal member to the breaker plate between the first flap and the bottom surface of the metal member, a second parallel fold creating a second flap for preventing water on the bottom surface of the flat expanded metal member from traveling over the gutter.

13. The method of claim 12 wherein the second flap has an angle greater than 90 degrees with respect to the bottom surface of the flat expanded metal member.

14. The method of claim 9 wherein the gutter cover is used with K-style gutter, ogee gutter, half round gutter, fascia gutter and box gutter.

15. The method of claim 9 wherein the first edge of the solid sheet member is adapted to slide up under roofing material to transition runoff water and debris from the roof onto the gutter cover.

16. The method of claim 9 wherein the gutter cover is secured to the gutter by inserting a zip screw through the breaker plate into the gutter for securing the gutter cover to the gutter.

17. A gutter cover distributing water across the face of the cover and controlling the rate of water ingress through the cover into the gutter thereby assisting in the separation of water and shedding of debris from the passing runoff water and debris, and preventing debris from building up on the gutter cover, the gutter cover comprising:

a solid sheet member having a top surface, an opposite bottom surface, a first edge adapted to be positioned under roofing material and a second parallel edge;

a flat expanded metal member having a top surface, an opposite bottom surface, a first and a second parallel edge, the first edge secured to the second edge of the solid sheet member;

a breaker plate secured to the second edge of the flat expanded metal member to thereby assist in preventing water on the bottom surface of the flat expanded metal member from traveling beyond the second edge over the front of the gutter; and the flat expanded metal member further comprising:

(a) a plurality of louvered surfaces formed by a plurality of longitudinal veins extending in a direction perpendicular to side edges of the flat expanded metal member; and (b) wherein the louvered surfaces of the flat expanded metal member of the gutter cover having an angle greater than 90 degrees with respect to the top surface of the flat expanded metal member, whereby the angle of the louvered surfaces being obtuse relative to water flow across the cover assists in distributing water across the face of the flat expanded metal member and slowing water ingress through the plurality of honeycombs into the gutter to thereby assist in both the separation of water and shedding of the debris from the passing runoff water and debris and preventing debris from building up on the gutter cover.

18. The gutter cover of claim 17 further comprising a plurality of honeycomb shapes each having a plurality of sides, a first side and second side being parallel, the sides having a top and a bottom surface, the honeycombs shapes connected by overlapping the bottom surface of the first side of one honeycomb shape with the top surface of the second side of another honeycomb shape.

19. The gutter cover of claim 18 wherein a longitudinal width between the overlapping sides being greater than a latitudinal width between the overlapping sides.

20. The gutter cover of claim 17 wherein the solid sheet member having a v-shaped trough between and running parallel to the first and the second parallel edges for breaking up and slowing the water before reaching the gutter cover.

21. The gutter cover of claim 17 wherein the second edge of the solid sheet member further comprises a first and a second fold parallel to the second edge, the first fold creating a first flap by folding the second edge over the top surface of the sheet member, the second fold creating a second flap by folding the second edge and first flap under the bottom surface of the sheet member, the flat expanded metal member being crimped between the first and second flaps to secure the flat expanded metal member to the sheet member.

22. The gutter cover of claim 17 wherein the breaker plate further comprises parallel edges, a top and an opposite bottom surface, a first fold creating a first flap for crimping the flat expanded metal member to the breaker plate between the first flap and the bottom surface of the metal member, a second parallel fold creating a second flap for preventing water on the bottom surface of the flat expanded metal member from traveling over the gutter.

23. A gutter cover distributing water across the face of the cover and controlling the rate of water ingress through the cover into the gutter thereby assisting in the separation of water and shedding of debris from the passing runoff water and debris, and preventing debris from building up on the gutter cover, the gutter cover comprising:

a solid sheet member adapted to transition water from roofing material onto the gutter cover; and a flat expanded metal member attached to the solid sheet member, the flat expanded metal member comprising a plurality of louvered surfaces having an angle being obtuse relative to water flow across the cover, the water passes over the obtusely angled plurality of louvered surfaces to control the rate of water ingress through the flat expanded metal member and to move debris across and off the flat expanded metal member to prevent debris from building up on the gutter cover.

24. The gutter cover of claim 23 where in the solid sheet member and the flat expanded metal member define a flow path for water and debris, whereby when water and debris pass along the flow path overtop of the flat expanded metal member they are slowed by the obtusely angled plurality of louvered surfaces, which are adapted to assist in slowing the rate of flow through the flat expanded metal member and to further assist in passing debris forward over and off the gutter cover to prevent debris from clogging the flat expanded metal member.

25. The gutter cover of claim 1 wherein the solid sheet member and flat expanded metal member define a flow path for runoff water and debris, the louvered surfaces of the flat expanded metal member of the gutter cover being angled away from a direction of flow for the water and debris passing through the flow path to assist in slowing water flow overtop and through the flat expanded metal member into the gutter and preventing debris from snagging or clogging the flat expanded metal member.

26. A gutter cover adapted for placement over top an opening of a gutter, the cover comprising:

a solid sheet member having a solid surface area defined by a top surface of the solid sheet member;

a planar expanded metal member attached to the solid sheet member and having an expanded metal surface area defined by a top surface of the expanded metal member;

the solid surface member covering at least half of the opening of the gutter; and the expanded metal member comprising a plurality of louvered surfaces, the louvered surfaces have an angle being obtuse relative to water flow across the cover so that water and debris passes over the top surface of the expanded metal surface to control the rate of water ingress through the expanded metal member.

* * * * *

UNITED STATES PATENT AND TRADEMARK OFFICE

CERTIFICATE OF CORRECTION

PATENT NO. : 7,870,692 B2
APPLICATION NO. : 11/380821
DATED : January 18, 2011
INVENTOR(S) : David Gregg It is certified that error appears in the above-identified patent and that said Letters Patent is hereby corrected as shown below:

Cover page, item (73):
DELETE after Assignee: "Premier Futter Cover LLC,"
ADD after Assignee: --Premier Gutter Cover LLC--

Signed and Sealed this
Twenty-second Day of March, 2011

David J. Kappos
*Director of the United States Patent and Trademark Office*